United States Patent [19]

Smith

[11] Patent Number: 4,961,251

[45] Date of Patent: Oct. 9, 1990

[54] FLEXIBLE SAFETY BELT BUCKLE GUARD

[76] Inventor: Ann Smith, R.D. #2, Box 11-D, Monongahela, Pa. 15063

[21] Appl. No.: 337,269

[22] Filed: Apr. 13, 1989

[51] Int. Cl.[5] ..... A44B 11/25

[52] U.S. Cl. ..... 24/633; 24/634

[58] Field of Search ..... 24/633, 634, 602, 603, 24/574, 625, 487; 297/482; 128/DIG. 15; 2/DIG. 6

[56] References Cited

U.S. PATENT DOCUMENTS

| | | | |
|---|---|---|---|
| 3,484,908 | 12/1969 | Lamb | 24/574 |
| 3,501,774 | 3/1970 | Norman | 2/DIG. 6 |
| 3,587,570 | 6/1971 | Kilbey | 128/DIG. 15 |
| 4,027,666 | 6/1977 | Marx | 128/DIG. 15 |
| 4,040,632 | 8/1977 | Pawl | 128/DIG. 15 |
| 4,120,052 | 10/1978 | Butler | 2/DIG. 6 |
| 4,502,194 | 3/1985 | Morris et al. | 24/633 |
| 4,624,033 | 11/1986 | Orton | 24/634 |
| 4,674,303 | 6/1987 | Salcone, II | 24/633 |
| 4,675,954 | 6/1987 | Gullickson | 24/633 |
| 4,693,495 | 9/1987 | La Pointe | 297/482 |
| 4,719,876 | 1/1988 | Wilken | 128/DIG. 15 |
| 4,731,912 | 3/1988 | Boriskie et al. | 24/574 |

FOREIGN PATENT DOCUMENTS

| | | | |
|---|---|---|---|
| 3445822 | 9/1986 | Fed. Rep. of Germany | 297/482 |

*Primary Examiner*—Victor N. Sakran

*Attorney, Agent, or Firm*—Gary P. Topolosky

[57] ABSTRACT

A safety belt buckle guard comprising a flexible body of fabric adapted to wrap around an engaged belt buckle assembly, a rigid member for preventing depression of the release mechanism on said belt buckle assembly, means for positioning the rigid member adjacent the flexible body or attaching it thereto, and means for connecting the flexible body to itself after it is wrapped an engaged belt buckle assembly. Preferred embodiments include connecting means consisting essentially of a pair of hook and loop fastener, or Velcro, strips attached to the flexible body interior and exterior along opposite edges of said flexible body.

17 Claims, 3 Drawing Sheets

FLEXIBLE SAFETY BELT BUCKLE GUARD

BACKGROUND OF THE INVENTION

This invention relates to seat belt buckle covers or guards. More particularly, the invention relates to a flexible belt buckle guard for preventing young children from unfastening themselves from a vehicular safety restraint. The invention further relates to a safety belt buckle guard having more universal applications.

Seat belts, or safety restraints, have been standard equipment on passenger vehicles for more than a generation. Under Federal law, children up to age two must now be restrained in an acceptable safety seat during any vehicular travel. Some states have extended mandatory seat belt wearing for children up to four, five, six or even nine years of age. In still other states, safety belts must now be worn by every driver and passenger regardless of age. The rationale for such laws has been repeatedly proven by statistics, namely that safety belts save lives. Safety belts are only effective at preventing injury and death as long as they remain engaged or fastened, however.

When travelling by car, most young children cannot avoid being drawn to the colorful belt and often shiny metallic buckle engaged around their waists, or around the safety seats in which they ride. For some safety seat designs, the belt buckle release mechanism is within easy reach of the child/occupant. So often, a child's hands naturally rest on or about the safety belt buckle assembly. Such hands will quickly learn how to disengage most any belt buckle without ever once witnessing another perform the same task.

Although children as old as one or two have sufficient strength and dexterity to operate the release mechanisms of most vehicular safety belts, they are not old enough to appreciate the importance of remaining fastened at all times. Motor vehicle accidents are the leading cause of death and crippling injury for young children in this country. As many as 700 children under five die each year from injuries sustained as motor vehicle passengers. Adults cannot always maintain constant supervision over their young passengers to assure that they remained fastened in appropriate safety restraints. To do so would be a greater distraction to drivers causing even more accidents, injuries and deaths. Hence, there exists a clear need for preventing babies, toddlers and other young children from unfastening or unbuckling themselves from such safety devices.

With any safety belt cover or guard design, there is no need to raise concerns about the operation of hidden or tricky release mechanisms by emergency medical personnel. In an accident or other emergency, paramedics are now trained to cut away safety belts rather than to waste time unfastening safety restraints of various sorts.

In Lamb U.S. Pat. No. 3,484,908, there is disclosed a safety belt cover consisting of two integrally molded faces that form a hollow cylinder into which an engaged belt buckle is slidably received. It is intended to prevent anyone from accidentally operating the quick release lever of an airplane safety belt or the like.

Kuszynski U.S. Pat. No. 3,566,455 shows a belt buckle cover with a flexible section 45 that extends over the buckle release mechanism to assist in its manual depression. This cover is not intended to prevent young children from operating said buckle release mechanism, however.

Orton U.S. Pat. No. 4,624,033 shows a child safety seatbelt securement device with a plastic housing for a complex release button actuator. The female end of a seatbelt buckle slides within one channel of this housing. Numerous housing shapes would be needed to accomodate the various belt buckle sizes on vehicles currently sold in this country.

In Gullickson U.S. Pat. No. 4,675,954, there is claimed a seat belt buckle cover having an outer surface which overlays the release control of a belt buckle, said outer surface being sufficiently rigid to prevent young children from activating the release but not so resilient as to prevent adults from activating the same control. By design, this cover is proportioned to slip over only one particular belt buckle shape.

Boriskie et al. U.S. Pat. No. 4,731,912 shows a hinged buckle guard for encasing standard GM, Ford and Chrysler seat belt buckles within a latched plastic box. This guard would not accomodate other than standard size belt buckles, however.

SUMMARY OF THE INVENTION

It is a principal object of this invention to provide a safety belt buckle guard or cover having more universal applications, i.e., for use with more than one belt buckle size and/or shape. It is another object to provide a safety belt buckle guard made from soft, more sensitive materials to the touch, such as fabric or cloth. It is yet another object to provide a buckle guard which remains attached to one free end of a safety belt for easy location during repeated installations. It is another object to provide a belt buckle guard with more than one securement means. Preferred embodiments include a first mechanical securement in combination with alternate, backup (or second) securement means.

It is another principal object to provide a belt buckle guard which takes little time and effort for an adult to install while being difficult or nearly impossible for children up to age five, six or even seven to disengage. It is yet another object to provide a buckle guard which does not require repeated slippage over a fully engaged belt and buckle assembly to install. It is another object to provide a buckle guard which does not require blindly connecting one seat belt end into a buckle assembly housed within a substantially plastic covering.

To accomplish the foregoing objectives, there is disclosed a safety belt buckle guard comprising a flexible body adapted to wrap around an engaged safety belt buckle assembly; a rigid member adapted to prevent depression of a release mechanism on the belt buckle; means for positioning the rigid member adjacent the flexible body; and means for connecting the flexible body to itself after it is wrapped around an engaged belt buckle assembly. There is further disclosed a universal safety belt guard which consists essentially of a substantially rectangularly-shaped body of flexible cloth; a rigid member attached to the flexible body interior, said rigid member adapted for positioning over the release mechanism of an engaged buckle assembly when the flexible body is wrapped therearound; and a pair of hook and loop fastener, or Velcro, strips attached to the flexible body interior and exterior adjacent its opposite edges.

BRIEF DESCRIPTION OF THE DRAWINGS

Further features, other objects and advantages of the present invention will be made clearer from the following detailed description of the preferred embodiments made with reference to the drawings in which.

DETAILED DESCRIPTION OF THE PREFERRED EMBODIMENTS

As used in this detailed description of the invention, the following definitions shall apply:

'Engaged belt buckle assembly' shall mean a safety belt and belt buckle whose male and female ends have been joined or fastened together, typically about the safety belt wearer or an appropriate car seat; and 'Universal' shall mean applicable to a greater number of belt buckle shapes, sizes and configurations, regardless of automotive make, model or year.

Figure 1:
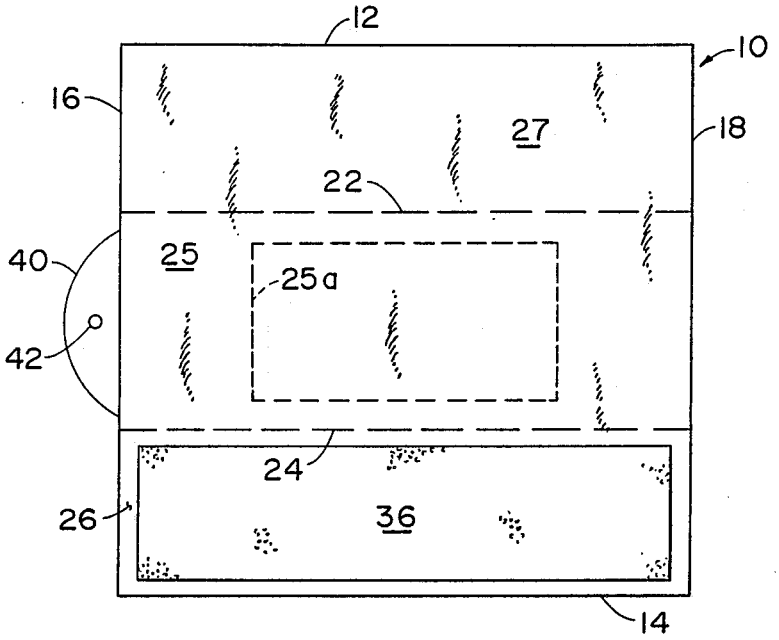
FIG. 1 is a top exterior view of one embodiment of belt buckle guard according to the invention.

Referring now to FIG. 1, there is shown the exterior view to one embodiment of the invention which includes a body of flexible material, generally 10, such as fabric, cloth or the like. Said body may be made from plain cotton, polyester or denim; from velour, tweeds or other materials to complement a car's interior. Other suitable fabrics may be printed with appropriate patterns of cartoon characters, toys, cars, sports team logos, dolls or the like, though patterns could undesirably draw a child's attention to the buckle guard rather than away from it. Body 10 may also be made from any other soft, pliable material or combination of materials. As shown, flexible body 10 has a substantially rectangular shape though it is to be understood that other fabric shapes may also perform the objects of this invention. Preferred embodiments of body 10 include a first pair of substantially parallel edges 12, 14 that extend latitudinally in FIG. 1, and a second pair of substantially parallel edges 16, 18 that extend longitudinally in the same figure, said latter edges adapted to wrap at least once around an engaged belt buckle assembly as best seen in later FIG. 5.

Figure 2:
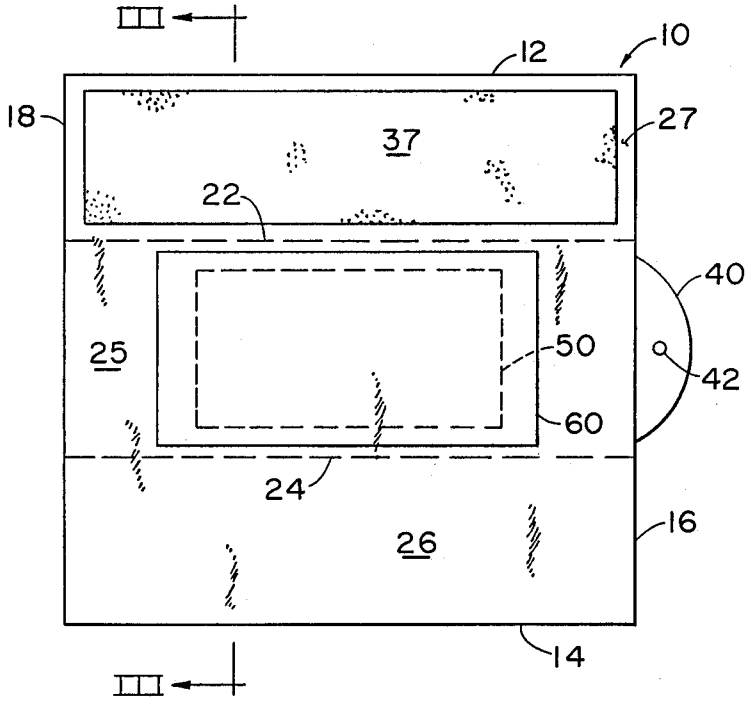
FIG. 2 is a top interior view of the buckle guard from FIG. 1.

On the exterior of flexible body 10, a pair of informal fold lines 22, 24 (shown by dotted lines) divide body 10 into three main parts: a first part 25 having a rigid member affixed or attached to its interior (the perimeter to said rigid member identified by dotted line **25*a* in FIG. 1); a second part 26 onto which a substantially wide (about 1 to 3 inches wide) strip of Velcro (hook or loop) fastener tape 36 has been glued, sewn or otherwise attached; and a third part 27 having an interior onto which the section of Velcro (loop or hook) fastener tape corresponding to section 36 has been attached (said corresponding section being identified as area 37 in following FIG. 2**).

Figure 6:
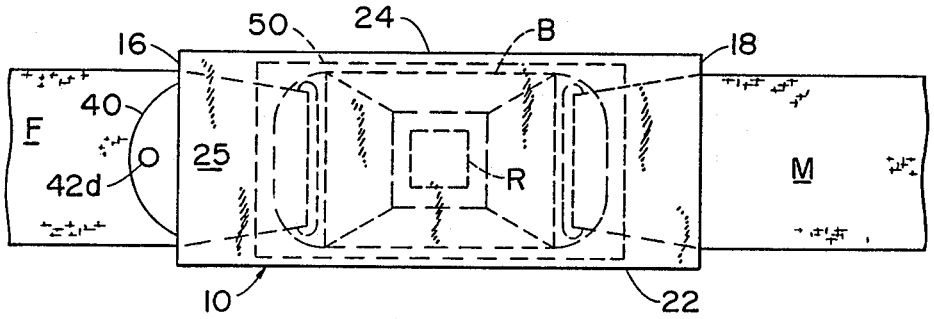
FIG. 6 is a top view of the FIG. 1 buckle guard wrapped or installed around an engaged belt buckle assembly.

FIG. 1 also illustrates preferred means by which to fix or attach body 10 to one of the two free safety belt ends, i.e. either the male belt strap or female buckle strap. More specifically, FIG. 1 includes a fabric extension 40 having an aperture 42 through which a rivet, tab tie or other attachment means extends. As shown in FIG. 6, extension 40 affixes the guard to female belt end F for quicker location during one of its repeated installations. When not in use, an opened guard may pivot about rivet **42*a*** but still remain within view and reach of the adult who has fastened, or is about to fasten, a fidgety youngster within the appropriate vehicular safety restraint.

In FIG. 2, the interior of flexible body 10 is shown is greater detail. As mentioned earlier, informal fold lines 22, 24 divide the guard into three main parts for fitting around a belt strap and buckle of standard thickness and shape. Because these fold lines are not permanently creased into the flexible fabric comprising body 10, this same guard may be used to wrap around smaller or still larger belt buckle assemblies.

The interior of first part 25 has positioned thereagainst a rectangular section of stiff material, or rigid member 50, shown in outline in FIG. 2. This rigid member 50 is adapted to prevent children from depressing the release mechanism of an engaged belt buckle after the invention has been installed therearound. Accordingly, rigid member 50 must be large enough to at least cover the release mechanism of most any safety belt design. For more universal application, though, the buckle guard of FIG. 2 has been oversized to hide an entire belt buckle assembly per later FIG. 6. Rigid member 50 may consist essentially of any material which prevents young children from easily depressing a buckle release or control positioned therebeneath. Suitable materials include stiff plastics, polymers and polyesters. Rigid member 50 may also be made from metals such as aluminum, steel or the like.

In any event, rigid member 50 must be permanently positioned adjacent flexible body 10 by some means and, most preferably, intermediate parallel edges 12, 14 of said body. In the cross sectional view shown at FIG. 3, one rigid member positioning means is depicted in greater detail. Particularly, member 50 is centered over the interior of first part 25 before a section of fabric 60, sized larger than rigid member 50 in all dimensions, is placed over member 50 and glued, sewn or otherwise attached to first part 25. Depending on the fabric design (or designs) selected for the flexible body interior, exterior and section 60, buckle guards of this invention may be made reversible for multiple applications. Alternate positioning means include gluing the rigid member directly to the interior of first part 25, or riveting the two main components of this buckle guard to each other through a plurality of rivet holes, pre-punched or otherwise.

Figure 3:
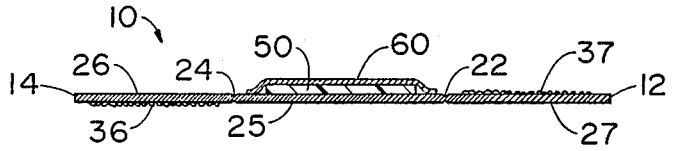
FIG. 3 is a sectional view taken along line III—III of FIG. 2.
Figure 4:
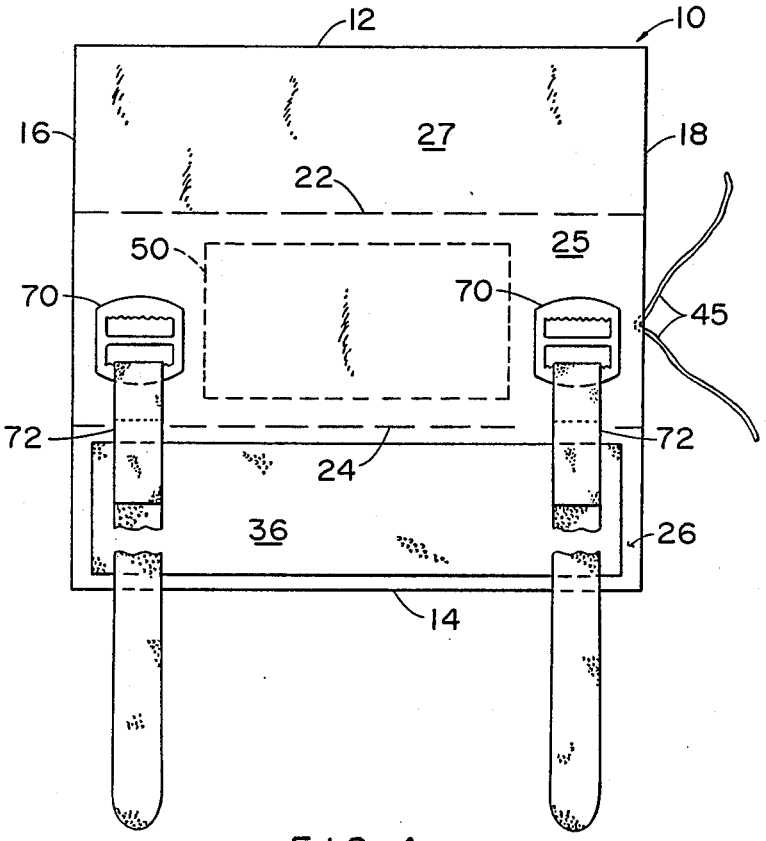
FIG. 4 is a top exterior view of another embodiment of the invention.

In accompanying FIG. 4, the top exterior view of an alternate embodiment of the invention is shown. For this figure, component parts having equivalents to the buckle guard of FIGS. 1 through 3 are correspondingly numbered. Hence, the FIG. 4 guard similarly includes a first part 25, second part 26 and third part 27 extending between substantially parallel edges 12, 14 of body 10. The FIG. 4 buckle guard also employs the same means for connecting its flexible body edges to each other, namely a pair of hook and loop fastener strips (preferably 1 inch wide or more) attached to interior and exterior of flexible body 10 along its opposite edges. In FIG. 4, only the top, exterior strip 36 is visible. A corresponding section of Velcro hooks (or loops, depending on the physical makeup of strip 36) attaches to the interior or underside of third part 27. Alternate connecting means include a plurality of hook and eye type fasteners, or ball and socket snaps, as are commonly used in many sewn clothing articles.

There are three major differences between the two embodiments of buckle guards depicted in FIGS. 1 and 4. Firstly, the FIG. 4 rigid member 50 is adhered directly to the interior of first part 25. Secondly, FIG. 4 includes a set of laces 45 for tying the buckle guard to a free safety belt end, said laces replacing the fabric extension 40 of FIG. 1. It should be noted that the attachment means extend from opposite sides of the guard exterior in FIGS. 1 and 4. Hence, the size, type and location for such attachment means is less critical to the invention. The FIG. 4 buckle guard includes a third main difference from FIG. 1, namely second means for connecting flexible body 10 around an engaged buckle assembly. Preferably, the second connecting means comprises a buckle 70 sewn, glued or otherwise attached to the exterior of body 10, typically by tacking onto first part 25 adjacent a vertical parallel edge 16 or 18, in combination with a strap 72 correspondingly sized to fit within the apertures of buckle 70. Strap 72 is glued or sewn around one end of buckle 70 and preferably includes both hook and loop sections for easier installation by wrapping about the buckle guard, passing through the free end of buckle 70, and tightly reconnecting to itself.

Figure 7:
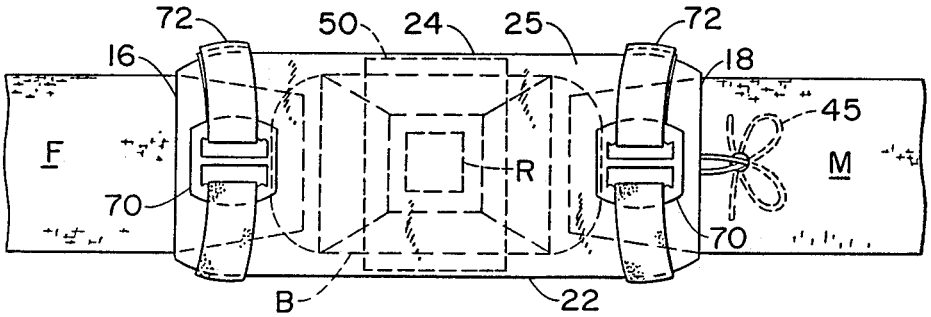
FIG. 7 is a top view of the FIG. 4 buckle guard wrapped or installed around an engaged belt buckle assembly.

In the alternate embodiment shown in FIG. 4, a pair of buckle 70 and strap 72 securement means are wrapped transversely around both ends of flexible body 10 in either the same (or opposite) direction in which the invention is wrapped around an engaged buckle assembly. The purpose for such second securement means are twofold. Through personal experimentation, the inventor has learned that a buckle guard strongly attached to itself by wide Velcro strips and no second securement means will prevent children up to age four or five from disengaging either the guard or an engaged belt buckle assembly. That is because at said ages, few children possess the strength to undo the wide hook and loop bands along the flexible body interior and exterior. When additional securement buckles and Velcro straps are transversely wrapped about the same guard, children up to age seven or eight cannot undo the latter securement means thereby preventing somewhat older passengers from getting undone. As best seen in FIG. 7, one or more transverse Velcro straps 72 also allow the buckle guard of this invention to be tightened at both longitudinal ends, thereby compensating for any differences in belt and buckle width dimensions.

Figure 5:
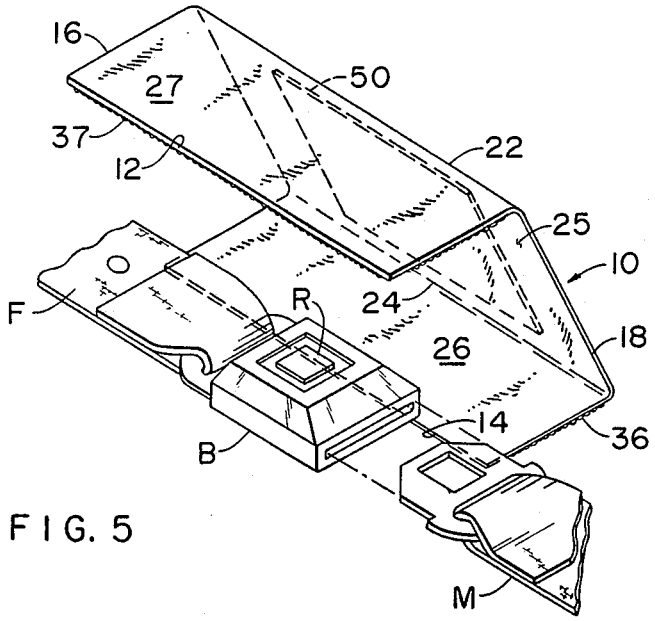
FIG. 5 is a perspective view of the invention during its installation.

Referring to FIG. 5, there is shown a representative installation of belt buckle guard around the soon-to-be engaged male M and female F ends of a belt buckle assembly. Once the flexible body 10 of guard has been wrapped at least once around the engaged assembly—with its rigid member 50 positioned directly over the release mechanism R of belt buckle B—hook and loop fastener strips 36 and 37 may be joined and pressed together. In FIGS. 6 and 7, fully installed belt buckle guards are shown with the belt buckle B, release R and rigid members 50 depicted in dotted lines only. It is important to note that the FIG. 7 buckle guard includes a smaller rigid member 50 than that shown in FIG. 6, the FIG. 7 member still being sufficiently sized to cover and prevent depression of buckle release R by adult or child after proper installation of the invention.

Having described the presently preferred embodiments, it is to be understood that the invention may be otherwise embodied within the scope of the appended claims.

What is claimed is:

1. A one piece safety belt buckle guard for preventing yound children from unfastening an engaged safety belt buckle assembly, said buckle guard comprising:

a flexible body adapted to be wrapped around the buckle assembly after each engagement of the same;

a rigid member adapted to prevent depression of a buckle assembly release mechanism through or beneath said rigid member;

means for positioning the rigid member adjacent the flexible body;

means for repeatedly connecting the flexible body to itself after being wrapped around the engaged belt buckle assembly; and second means for connecting the flexible body around the belt buckle assembly.

2. The belt buckle guard of claim 1 wherein the flexible body consists essentially of fabric.

3. The belt buckle guard of claim 1 wherein the rigid member consists essentially of plastic.

4. The belt buckle guard of claim 1 wherein the rigid member consists essentially of metal.

5. The belt buckle guard of claim 1 wherein the rigid member positioning means includes a section of fabric sized to fit over the rigid member and attach to the flexible body interior.

6. The belt buckle guard of claim 1 wherein the rigid member positioning means includes a plurality of rivets.

7. The belt buckle guard of claim 1 wherein the flexible body connecting means includes a pair of hook and loop fastener strips attached to the flexible body interior and exterior along opposite edges of said body.

8. The belt buckle guard of claim 1 wherein the flexible body connecting means includes a plurality of ball and socket snaps.

9. The belt buckle guard of claim 1 wherein the flexible body connecting means includes a plurality of hook and eye type fasteners.

10. The belt buckle guard of claim 1 which further comprises means for attaching the guard to a free end of safety belt.

11. The belt buckle guard of claim 1 wherein the second connecting means includes at least one buckle and transversely-oriented strap having both hook and loop sections.

12. A one piece safety belt buckle guard for preventing young children from unfastening an engaged safety belt buckle assembly, said buckle guard comprising:

a flexible body having at least two substantially parallel edges;

an unexposed rigid member for preventing depression of a buckle assembly release mechanism, said rigid member positioned intermediate the parallel edges of the flexible body;

first means for repeatedly connecting the parallel edges of the body to each other after said body has been wrapped around the engaged buckle assembly; and second means for securing the flexible body around the engaged buckle assembly.

13. The belt buckle guard of claim 12 wherein the flexible body consists essentially of fabric and the rigid member consists essentially of plastic.

14. The belt buckle guard of claim 12 wherein the first connecting means includes a wide Velcro strip attached to the flexible body interior along its parallel edge and a wide corresponding Velcro strip attached to the flexible body exterior along its parallel edge.

15. The belt buckle guard of claim 12 which further includes means for attaching the guard to a free safety belt end.

16. The belt buckle guard of claim 12 wherein the second connecting means includes one or more buckles with Velcro hook and loop straps, said straps extending along opposite edges of the flexible body in substantially the same direction in which said body is wrapped around the engaged buckle assembly.

17. A universal, one piece belt buckle guard for preventing young children from unfastening an engaged safety belt buckle assembly, said buckle guard comprising:

a substantially rectangularly-shaped body of flexible fabric adapted for wrapping around the buckle assembly after each engagement of the same;

a rigid member attached to the flexible body interior, said rigid member adapted for positioning over a release mechanism of the engaged buckle assembly when the flexible body is wrapped therearound;

a pair of hook and loop fastener straps attached to the flexible body interior and exterior along its opposite edges, said fastener straps adapted for repeatedly securing the flexible body around the engaged buckle assembly; and one or more of: means for attaching the guard to one free end of safety belt; and at least one buckle and transversely-oriented stsrap, said strap having both hook and loop sections.

* * * * *